US011788208B2

(12) United States Patent
Hansen et al.

(10) Patent No.: US 11,788,208 B2
(45) Date of Patent: Oct. 17, 2023

(54) CONTINUOUS-FILAMENT SPUNBOND

(71) Applicants: Reifenhaeuser GmbH & Co. KG Maschinenfabrik, Troisdorf (DE); Fibertex Personal Care A/S, Aalborg (DK)

(72) Inventors: Morten Rise Hansen, Aalborg (DK); Sebastian Sommer, Troisdorf (DE)

(73) Assignees: REIFENHAEUSER GMBH & CO. KG MASCHINENFABRIK, Troisdorf (DE); FIBERTEX PERSONAL CARE A/S, Aalborg (DK)

( * ) Notice: Subject to any disclaimer, the term of this patent is extended or adjusted under 35 U.S.C. 154(b) by 0 days.

(21) Appl. No.: 16/084,048

(22) PCT Filed: May 17, 2017

(86) PCT No.: PCT/EP2017/061877

§ 371 (c)(1),
(2) Date: Sep. 11, 2018

(87) PCT Pub. No.: WO2017/198730

PCT Pub. Date: Nov. 23, 2017

(65) Prior Publication Data

US 2019/0194826 A1 Jun. 27, 2019

(30) Foreign Application Priority Data

May 18, 2016 (DE) ..... 102016109115.4

(51) Int. Cl.

| | |
|---|---|
| ***D01F 1/10*** | (2006.01) |
| ***D01F 8/06*** | (2006.01) |
| ***D04H 3/147*** | (2012.01) |
| ***D04H 3/16*** | (2006.01) |
| ***D01D 5/098*** | (2006.01) |

(52) U.S. Cl.

CPC ..... *D01D 5/0985* (2013.01); *D01F 1/10* (2013.01); *D01F 8/06* (2013.01); *D04H 3/147* (2013.01); *D04H 3/16* (2013.01); *D10B 2321/022* (2013.01)

(58) Field of Classification Search

CPC .. D04H 3/147; D04H 1/43828; D04H 1/5412; D04H 1/544; D01F 8/06; D01F 1/10

See application file for complete search history.

(56) References Cited

U.S. PATENT DOCUMENTS

| | | | | |
|---|---|---|---|---|
| 5,082,720 A * | 1/1992 | Hayes | ..... | D04H 1/54 442/362 |
| 6,355,348 B1 * | 3/2002 | Takesue | ..... | D01F 6/30 428/373 |
| 8,389,428 B2 | 3/2013 | Dahringer | | |

(Continued)

*Primary Examiner* — Larissa Rowe Emrich
(74) *Attorney, Agent, or Firm* — Andrew Wilford

(57) ABSTRACT

The invention relates to a spunbonded fabric of endless filaments made of thermoplastic plastic, wherein the endless filaments are designed as multi-component filaments having a core/sheath configuration. The filaments contain at least one lubricant, the lubricant being present exclusively or at least to 90 wt. % in the core component. The mass ratio between the core component and the sheath component is 65:35 to 80:20. The proportion of the lubricant is 250 to 5500 ppm with respect to the total filament.

4 Claims, 1 Drawing Sheet

(56) References Cited

U.S. PATENT DOCUMENTS

| | | | | |
|---|---|---|---|---|
| 2003/0157859 | A1* | 8/2003 | Ishikawa | D04H 3/16 442/340 |
| 2007/0055015 | A1* | 3/2007 | Flood | C08L 23/10 525/88 |
| 2009/0111347 | A1* | 4/2009 | Peng | D01F 1/10 442/334 |
| 2011/0165470 | A1* | 7/2011 | Dahringer | D04H 1/00 428/221 |
| 2011/0183568 | A1* | 7/2011 | Haubruge | D04H 3/147 156/244.11 |
| 2012/0045956 | A1* | 2/2012 | Tau | D01F 6/46 526/348 |
| 2013/0309931 | A1* | 11/2013 | Koori | D01F 6/46 442/401 |
| 2016/0076171 | A1 | 3/2016 | Gallez | |

* cited by examiner

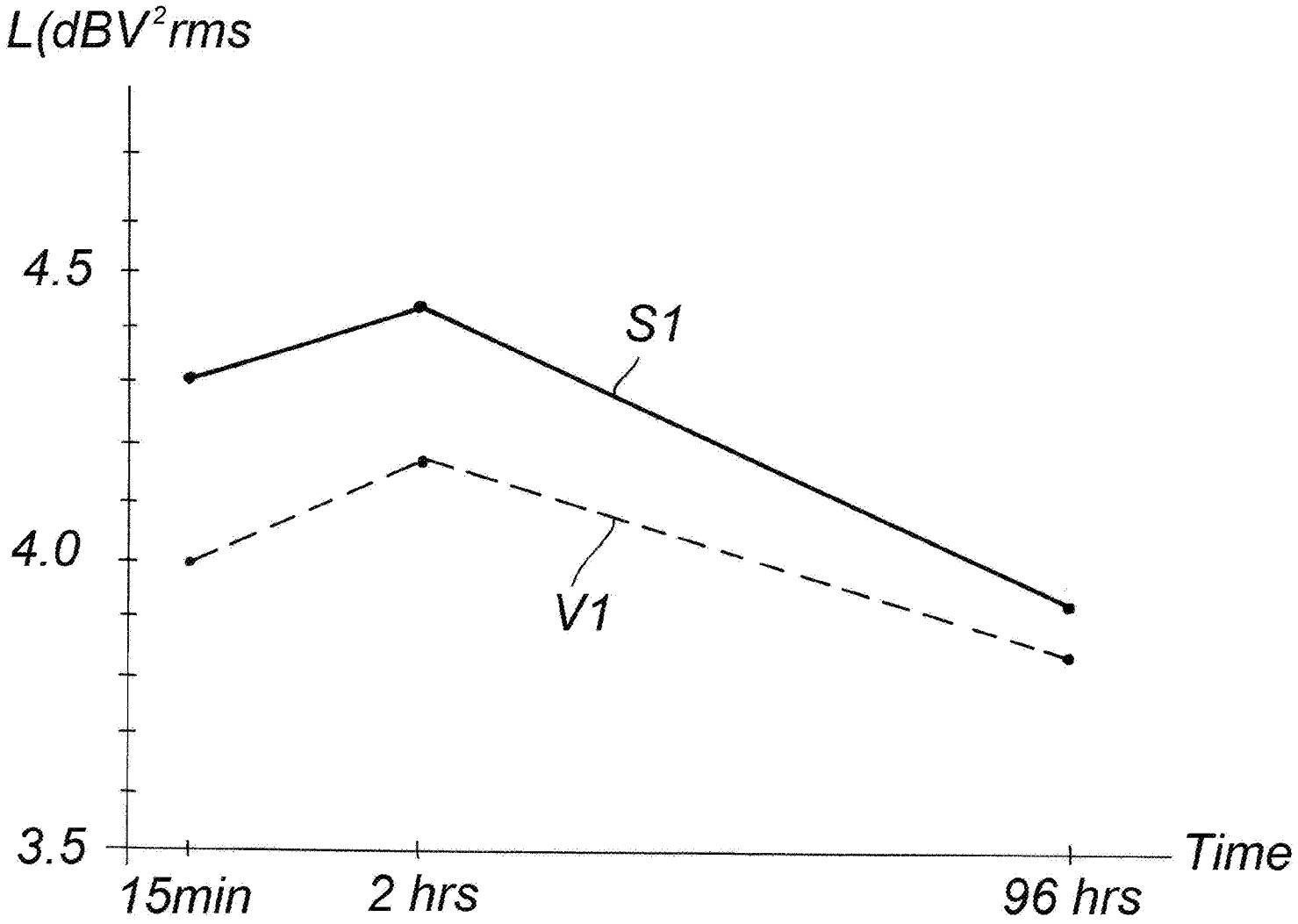
L(dBV²rms
4.5
4.0
3.5
S1
V1
15min
2 hrs
96 hrs
Time

CONTINUOUS-FILAMENT SPUNBOND

CROSS REFERENCE TO RELATED APPLICATIONS

This application is the US-national stage of PCT application PCT/EP2017/061877 filed 17 May 2017 and claiming the priority of German patent application 102016109115.4 itself filed 18 May 2016.

FIELD OF THE INVENTION

The invention relates to a nonwoven spunbonded of continuous thermoplastic filaments, the filaments being multicomponent filaments, particularly bicomponent filaments having a core/sheath configuration. According to the invention, the spunbonded nonwoven has continuous filaments. Such continuous filaments differ from staple fibers on account of their quasi endless length, whereas staple fibers have much shorter lengths of for example 10 to 60 mm.

BACKGROUND OF THE INVENTION

Spunbonded nonwovens of the above-described type are known from practice in various variants. In such spunbonded nonwovens, high strength, more particularly high tensile strength, is generally desirable. For many applications, the spunbonded nonwovens should also have a smooth, soft feel. It is often not possible to achieve the combination of a soft feel of the spunbonded nonwovens on the one hand and high strength or tensile strength thereof on the other hand. Above all, a soft feel cannot be achieved simultaneously along with high productivity or plant productivity.

Polypropylene spunbonded nonwovens have been known for some time and are characterized by good running behavior on the associated system. In particular, relatively little fouling occurs. However, these spunbonded nonwovens are not particularly soft, and the possibilities for improving the softness by using finer fibers, for example, are limited and often not economical. While it is possible to use a lubricant to increase the softness of the spunbonded nonwoven, that does not change the relatively high bending stiffness of the filaments and thus cannot result in a satisfactorily soft spunbonded nonwoven. The use of such a lubricant has the disadvantage that the lubricant diffuses out of the filament melt or out of the initially hot filaments during the spinning process and contaminates the system, which ultimately reduces productivity.

In order to improve the softness, polypropylene blends such as blends of homopolypropylene and polypropylene-based copolymers like "random CoPP," for example, have been introduced. These blends do yield flexurally soft filaments, but they are usually characterized by a rather dull feel that in turn necessitates the use of additional lubricants. These soft polypropylene blends have disadvantageously reduced strength. In addition, the problems with contamination described above are also present here. When using certain bicomponent filaments having a core/sheath configuration, a compromise between acceptable softness and adequate strength can be achieved. A homopolypropylene in the core thus improves the strength, and soft polypropylene blends or the use of polypropylene copolymer in the sheath increase the softness of the filaments and/or of the spunbonded nonwoven. However, the respective filament surfaces are also relatively dull. This makes the use of a lubricant necessary, which, in turn, brings about the above-mentioned problems associated with contamination.

At the high production speeds of modern systems for producing spunbonded nonwovens, a combination of a so-called jumbo-roll winder and a rollover cutting machine is used, since direct winding is no longer possible at these high production speeds. The jumbo rolls are temporarily stored during the time between the production of the spunbonded nonwoven and the associated generation of the jumbo roll on the one hand and the time of the rollover cutting process on the other hand, and this period may well take several hours. During this time, a lubricant that is used can migrate to the surface of the filaments, thus making the filaments or the spunbonded nonwovens smoother and causing the rolling behavior to deteriorate. A need therefore exists for the ability to adjust the filaments or spunbonded nonwovens when using a lubricant in such a way that positive end properties are maintained on the one hand and the system is contaminated as little as possible on the other hand, with the production speed, windability, and process reliability remaining optimized and/or still being optimizable.

During the production of spunbonded nonwovens from continuous filaments, it is generally already known to incorporate softening additives and/or lubricants into the thermoplastic of the filaments. The lubricant is introduced into the filaments in a quasi-homogeneous manner. However, these known measures have the disadvantage that the additives added during spunbonded nonwoven production can evaporate from the filaments and contaminate the system or, in particular, precipitate in the air-conducting components of the system. These negative effects are of course undesirable.

OBJECT OF THE INVENTION

In contrast, the object of the invention is to provide a spunbonded nonwoven of the above-described type that is characterized both by a smooth, soft feel and by adequate strength, that can be produced in a simple and efficient manner, and, above all, in which evaporation of softening additives and/or evaporation of lubricants can be largely avoided.

SUMMARY OF THE INVENTION

In order to attain this object, the invention according to a first embodiment (A) teaches a nonwoven spunbonded of continuous thermoplastic filaments in which the filaments are formed as multicomponent filaments, particularly as bicomponent filaments having a core/sheath configuration, the filaments containing at least one lubricant, and the lubricant being present in the core exclusively or in a quantity of at least 90 wt %, preferably at least 95 wt %, with the mass ratio between the core and the sheath being from 40:60 to 90:10, preferably from 60:40 to 85:15, more preferably from 65:35 to 80:20, and especially preferably from 65:35 to 75:25. With respect to the overall filament, the proportion of the lubricant corresponds to 250 to 5500 ppm, preferably 500 to 5000 ppm, more preferably 700 to 3000 ppm, and especially preferably 700 to 2500 ppm. According to an especially preferred embodiment of the first embodiment A, the mass ratio between the core and the sheath in the first embodiment is 67:33 to 73:27 and preferably 70:30 or about 70:30.

To attain the object, the invention also teaches, according to a first embodiment (B), a nonwoven spunbonded of continuous thermoplastic filaments in which the continuous filaments are multicomponent filaments, particularly as bicomponent filaments having a core/sheath configuration, the filaments containing at least one lubricant, the proportion of the lubricant with respect to the overall filament being 250 to 5500 ppm, preferably 500 to 5000 ppm, more preferably 700 to 3000 ppm, and very preferably 700 to 2500 ppm, and the lubricant is exclusively present in the core or in a quantity of at least 90 wt %, preferably at least 95 wt %, and where, in the period up to 150 minutes after the production of the spunbonded nonwoven, the surface of the spunbonded nonwoven is harder, particularly by more than 3%, preferably by at least 3.2%, more preferably by at least 3.3%, and most particularly by at least 3.5%, than the surface of a reference spunbonded nonwoven that was otherwise produced under the same conditions having a homogeneous distribution of the lubricant with respect to the filament cross section, and where, after 96 hours, the surface of the spunbonded nonwoven has the same degree of hardness or degree of softness or approximately the same degree of hardness or degree of softness as the reference spunbonded nonwoven, with the degrees of hardness then preferably differing by no more than 3%, more preferably by no more than 2.9%, and particularly by no more than 2.8%. In the context of the first embodiment B, the mass ratio between the core and the sheath is preferably 40:60 to 90:10, advantageously 60:40 to 85:15, particularly 65:35 to 80:20, preferably 65:35 to 75:25, and very preferably 67:33 to 73:27.

According to a highly recommended variant of the first embodiment, the sheath is free of lubricant or substantially free of lubricant. In the first embodiment, the sheath can act as a sort of migration brake for the lubricant present in the core.

To attain the object, the invention also teaches, according to a second embodiment (A), a nonwoven spunbonded of continuous thermoplastic filaments where the continuous filaments are multicomponent filaments, particularly as bicomponent filaments having a core/sheath configuration, the filaments contain at least one lubricant, the proportion of the lubricant, with respect to the overall filament, is 250 to 5500 ppm, preferably 500 to 5000 ppm, more preferably 700 to 3000 ppm, and especially preferably 700 to 2500 ppm, and at least one additive that reduces the migration speed of the lubricant through the sheath is also included in the sheath.

Moreover, to attain the inventive object, the invention also teaches, according to a second embodiment (B), a nonwoven spunbonded of continuous thermoplastic filaments, where the continuous filaments are multicomponent filaments, particularly as bicomponent filaments having a core/sheath configuration, the filaments contain at least one lubricant, wherein the proportion of the lubricant, with respect to the overall filament, is 250 to 5500 ppm, preferably 500 to 5000 ppm, more preferably 700 to 3000 ppm, and very preferably 700 to 2500 ppm, the lubricant is preferably present in the sheath, with at least one additive that reduces the migration speed of the lubricant through the sheath being contained in the sheath, and, in the period up to 150 minutes after spunbond production, the surface of the spunbonded nonwoven is harder, particularly by more than 3%, preferably by at least 3.2%, more preferably by at least 3.3%, and most particularly by at least 3.5%, than the surface of a reference spunbonded nonwoven that was otherwise made under the same conditions without an additive that reduces the migration speed of the lubricant, and where, 96 hours after spunbond production, the surface of the spunbonded nonwoven has the same degree of hardness or degree of softness or approximately the same degree of hardness or degree of softness as the reference spunbonded nonwoven, with the degrees of hardness then preferably differing by no more than 3%, more preferably by no more than 2.9%, and particularly by no more than 2.8%. The fact that, in the first embodiment B and the second embodiment B, the surface of the spunbonded nonwoven is harder than the surface of a reference spunbonded nonwoven by more than 3%, etc., in the period up to 150 minutes after spunbond production means, in particular, that there is at least one point in time during the 150 minutes after spunbond production at which this tolerance limit is exceeded. Depending on the choice of raw material, and depending on the lubricant or proportion of lubricant, it may take 120 minutes until the tolerance limit is exceeded, for example. Under other conditions, however, the tolerance limit may already be exceeded after only 15 minutes, or the tolerance limit is exceeded over the entire period or substantially over the entire period. The migration speeds are relevant in this regard depending on the sheath raw material and/or depending on the proportion of the sheath in the filament.

The time period of up to 150 minutes chosen here is adapted to the measuring device described below; furthermore, it also takes typical times after which the jumbo rolls can be rolled over into account. With the chosen method, it is not possible to perform a hardness measurement directly during spinning. It lies within the scope of the invention for such a measurement to take about 15 minutes, so it cannot be performed continuously, either. However, in order to still serve as an aid for decision-making during production, the cited period cannot be chosen to be too long. Overall, this time period enables the decision to be made regarding the spinning behavior (system cleanliness) and winding behavior.

The Solutions According to the Second Embodiment of the Invention

Advantageously, in the context of the second embodiment (A and B), the mass ratio between the core and the sheath is preferably 40:60 to 90:10, advantageously 60:40 to 85:15, particularly 65:35 to 80:20, preferably 65:35 to 75:25, and very preferably 67:33 to 73:27.

It lies within the scope of the invention for the degree of hardness of the spunbonded nonwoven on the nonwoven surface to be determined by a TSA measuring device (from the company Emtec, Leipzig, Germany) as the sound intensity at the peak maximum of the sound intensity/frequency spectrum at about 6550 Hz. This TSA measuring device outputs the product characteristic as a "TS7" value. The TS7 value correlates with the softness of the nonwoven fabric. A spunbonded nonwoven of rough/blunt filaments has a higher TS7 than a comparable spunbonded nonwoven of smoother/softer filaments. According to the invention, the degree of hardness and/or the sound intensity on the surface of the spunbonded nonwoven is measured in the period up to 150 minutes after spunbond production. The term "spunbond production" refers to the depositing of the filaments in the deposit area or on the screen deposit belt after they have been spun. The measurement is thus performed in the period up to 150 minutes after this depositing of the filaments in the deposit area or on the screen deposit belt. It lies within the scope of the invention for this measurement to be performed after all precompaction and/or compaction measures that are carried out on the nonwoven, particularly in the deposit area or on the screen deposit belt. In particular, this also includes compaction by a calender with a gravure roll. The degree of hardness is thus measured after this compaction, as long as it is carried out in a period of up to 150 minutes after the depositing of the filaments in the deposit area or on the screen deposit belt. The measurement of the degree of hardness is advantageously performed prior to the winding of the spunbonded nonwoven onto a roll or after the winding of the spunbonded nonwoven onto a roll, but always with the proviso that this measurement be carried out in a period of up to 150 minutes after the depositing of the filaments.

It lies within the scope of the invention for the degree of hardness to be measured using a commercially available TSA measuring device (Tissue Softness Analyzer) from Emtec, Leipzig, Germany. The following standard method is preferably employed in that case:

- Clamping of a specimen of the nonwoven to be analyzed,
- Lowering of the 8-plate standard rotor onto the nonwoven surface. With a force of 100 $M_n$ of the rotor on the nonwoven specimen, the rotor rotates at a speed of 2/sec.
- This rotation causes the fleece sample or the rotor to vibrate/make noises, and a microphone records this reaction.
- The measured noises are converted into a sound frequency spectrum by a Fourier transformation.

The sound intensity of the local maximum volume in the range around 6550 Hz is outputted by the measuring device as "TS7."

This audio frequency spectrum is dependent on the overall structure of the nonwoven surface, and the amplitude of the sound intensity depends inter alia on the height of the nonwoven structure and on the degree of hardness of the nonwoven surface and/or filament surfaces. Properties such as surface topology become clear in the range below 1000 Hz, and softness in the range around 6550 Hz. The TS7 value is used as a characteristic measurement of the degree of hardness in the context of the invention. The percentages indicated there for differences in the degree of hardness thus relate to this value. Advantageously, the sound intensity and/or the degree of hardness of the nonwoven of reference is set equal to 100%, and the percentage deviation of the sound intensity and/or the degree of hardness of the spunbonded nonwoven according to the invention is determined. A description of such a method of measurement for the degree of hardness or for the degree of softness is also found in "Schloßer U., Bahners T., Schollmeyer E., Gutmann J.: *Griffbeurteilung von Textilien mittels Schallanalyse* [Assessment of the feel of textiles by sound analysis, Melliand Textilberichte 1/2012, 43 to 45.

As part of the production of the spunbonded nonwoven according to the invention, the filaments are preferably deposited in a deposit area, particularly on a screen deposit belt. It lies within the scope of the invention if the measurement of the degree of hardness is performed on the surface of the spunbonded nonwoven that is facing away from the deposit area or from the screen deposit belt. If the nonwoven web or the spunbonded nonwoven is compacted by a calender with gravure roll, the measurement of the degree of hardness is advantageously performed on the surface of the spunbonded nonwoven that is facing toward the gravure roll, which is preferably the surface of the spunbonded nonwoven that is facing away from the deposit area or from the screen deposit belt. It lies within the scope of the invention for the spunbonded nonwoven according to the invention, on the one hand, and the nonwoven of reference, on the other hand, to be produced under the same conditions, particularly using the same system or spunbonding system, and for them to be deposited in the same deposit or on the same screen deposit belt. Furthermore, it lies within the scope of the invention for the spunbonded nonwoven, on the one hand, and the nonwoven of reference, on the other hand, to be compacted in the same manner, particularly using the same calender or the like, and for the filaments of the spunbonded nonwoven, on the one hand, and the nonwoven of reference, on the other hand, to have the same titer.

The following conditions apply to all embodiments (first and second embodiment):

Raw material mixtures that are preferably compatible can be used in the core and/or in the sheath. In the context of the invention, "core/sheath configuration" means that the sheath surrounds the core completely or substantially completely. For all embodiments of the invention, the continuous filaments of the spunbonded nonwoven preferably have a titer of from 1.0 to 2.5 denier and more preferably a titer of from 1.2 to 2.2 denier.

It lies within the scope of the invention, particularly in the context of the embodiments B, for the core/sheath configuration to be an eccentric core/sheath configuration. The suitable selection of raw materials or plastic components then preferably results in a helically crimped filament.

In the context of the first and second embodiments, it is recommended that the core and/or the sheath have at least 90 wt %, preferably at least 95 wt %, and more preferably at least 96 wt % of at least one component from the group "polyolefin, polyolefin copolymer, mixture of polyolefin and polyolefin copolymer." It is especially preferred that the core and/or the sheath have at least 90 wt %, preferably at least 95 wt %, and more preferably at least 96 wt % of at least one component from the group "polypropylene, polypropylene copolymer, mixture of polypropylene and polypropylene copolymer.", It is advantageous if the core and/or the sheath consists substantially of a polyolefin and/or substantially of a polyolefin copolymer and/or substantially of a mixture of polyolefin and polyolefin copolymer. According to a highly recommended embodiment of the first and second embodiments, the core and/or the sheath consist essentially of a polypropylene and/or substantially of a polypropylene copolymer and/or substantially of a mixture of a polypropylene and a polypropylene copolymer. The qualification "substantially" in the variants described above takes into account the fact that additives, particularly the lubricant and optionally an additive that reduces the migration speed of the lubricant, are contained in the core and/or sheath. Preferably, the proportion of the additives (lubricant, optionally the additive that reduces the migration speed of the lubricant, and any other additives, such as color additives) is, with respect to the overall filament, no more than 10 wt %, preferably no more than 8 wt %, more preferably no more than 6 wt %, and very preferably no more than 5 wt %. Moreover, according to one advantageous embodiment, the polypropylene copolymer that is used in the context of the invention is ethylene propylene copolymer. It is recommended that the ethylene propylene copolymer used have an ethylene content of from 1 to 6%, preferably from 2 to 6%. It is recommended that the polypropylene copolymer that is preferably used have a melt flow index (MFI) of from 19 to 70 g/min, particularly from 20 to 70 g/min, preferably from 25 to 50 g/min. It has proven advantageous for the polypropylene copolymer to have a molecular weight distribution or molar mass distribution ($M_w/M_n$) of from 2.5 to 6, preferably from 3 to 5.5, and very preferably from 3.5 to 5.

One recommended variant of the first and the second embodiments of the invention is characterized in that the core consists substantially of a homopolyolefin, in particular substantially of a homopolypropylene. It has proven advantageous if the core has at least 80 wt %, preferably at least 85 wt %, more preferably at least 90 wt %, and especially preferably at least 95 wt % of the homopolyolefin, particularly of the homopolypropylene. One recommended embodiment of the first and the second embodiments is further characterized in that the sheath consists substantially of a polyolefin copolymer, in particular substantially of a polypropylene copolymer and/or substantially of a mixture of a polyolefin or homopolyolefin with a polyolefin copolymer, in particular substantially of a mixture of a polypropylene or homopolymer polypropylene with a polypropylene copolymer.

In both the first and second embodiments of the invention, the substances specified below are preferably used as lubricants. Advantageously, at least one fatty acid derivative and preferably at least one substance from the group "fatty acid ester, fatty acid alcohol, fatty acid amide" is used as lubricant. One recommended embodiment of the invention is characterized in that at least one stearate, particularly glycerol monostearate, and/or a fatty acid amide such as erucic acid amide and/or an oleamide, for example, is used as a lubricant. It is also possible to use ethylene bis(stearamide), for example. According to one proven variant, the erucic acid amide product SL05068PP from Constab is used.

The variants described below apply particularly to the first embodiment A or B:

One variant of the first embodiment of the invention is characterized in that both the core and the sheath of the continuous filaments of the spunbonded nonwoven according to the invention consist or substantially consist of a homopolyolefin, preferably of a homopolypropylene. In this variant of the first embodiment, the mass ratio between the core and the sheath is advantageously 40:60 to 90:10 and preferably 67:33 to 75:25. It is recommended that, in the first embodiment, the at least one lubricant be admixed only with the core or that the lubricant make up at least 95 wt %, preferably at least 98 wt %, of the core. In this variant, it is recommended that a proportion or an average proportion of the lubricant of from 250 to 5000 ppm and preferably of from 1000 to 5000 ppm be present in the entire continuous filament. A higher sheath portion of the filaments having a core/sheath configuration hinders the migration of the lubricant from the core more effectively; on the other hand, the lubricant content in the core must continue to rise for the final effect. The lower limits of the core portion, for example, are dictated by the extruder used or by the refeeding of a recyclate into the core.

Another variant of the first embodiment of the invention is characterized in that the core consists or substantially consists of a homopolyolefin, particularly of a homopolypropylene, and that the sheath consists or substantially consists of a mixture of a homopolyolefin, particularly a homopolypropylene, and of a polyolefin copolymer, particularly a polypropylene copolymer. According to an advantageous embodiment, the homopolyolefin, particularly the homopolypropylene in the core, is identical to the homopolyolefin or homopolypropylene in the sheath. Preferably, the proportion of the homopolyolefin, particularly of the homopolypropylene, in the sheath is from 40 to 90 wt %, preferably from 70 to 90 wt %, and more preferably from 75 to 85 wt % (with respect to the sheath). The proportion of the polyolefin copolymer or of the polypropylene copolymer in the sheath is advantageously from 50 to 10 wt %, preferably from 30 to 10 wt %, and more preferably from 25 to 15 wt % (with respect to the sheath). It is recommended that the polyolefin copolymer, particularly the polypropylene copolymer, used here have a melt flow index (MFI) of from 5 to 30 g/10 min, preferably from 5 to 25 g/10 min. In the context of the invention, the melt flow index (MFI) is measured particularly in accordance with ISO 1133, specifically at 230° C. and 2.16 kg for polypropylene and polypropylene copolymer. The polyolefin copolymer or the polypropylene copolymer preferably has an ethylene content of from 2 to 20%, preferably from 4 to 20%. The polyolefin copolymer or polypropylene copolymer of this embodiment is preferably characterized in terms of carbon atoms by an average C2 content in the range from 2 to 6%. Exxon Vistamaxx 3588 and/or Exxon Vistamaxx 6202 or a polypropylene having similar properties is preferably used as the polypropylene copolymer. The polypropylene copolymer is mixed as described above with the homopolyolefin or homopolypropylene for the sheath. Preferred specifications for the homopolypropylene are listed further below.

During manufacture of the spunbonded nonwoven according to the invention, the thermoplastic used can be refed as a recyclate. It is advantageous in this respect, particularly in the first embodiment of the invention, if the recycle stream is used exclusively or primarily for the core. A recirculated recyclate loaded with lubricant is then returned only to the core, and it is ensured that the sheath remains free of lubricant or substantially free of lubricant. In the case of recyclate refeeding with copolymer fractions in the recycle stream, copolymer is then also conveyed to the core. Nonetheless, the sheath remains free of lubricant or substantially free of lubricant.

In the first embodiment of the invention, the at least one lubricant is present exclusively or for the most part in the core. The second embodiment of the invention is explained in greater detail below. One variant of the second embodiment A of the invention is characterized in that the lubricant is present in the sheath and, according to one embodiment of the invention, the lubricant is contained only in the sheath. In principle, lubricant may also be present in or even only in the core in the second embodiment A of the invention. According to the second variant B, lubricant is preferably present in the sheath. According to one embodiment, the lubricant may be contained only in the sheath. In principle, however, lubricant can also be present in the core in this second embodiment B.

In the second embodiment of the invention, the core can consist or consist substantially of a homopolyolefin and particularly of a homopolypropylene. According to another variant, the core has at least 75 wt %, preferably at least 80 wt %, more preferably at least 85 wt %, and especially preferably at least 90 wt % of the homopolyolefin, particularly of the homopolypropylene.

One recommended variant of the second embodiment of the invention is characterized in that the sheath or the lubricant-containing sheath consists or substantially consists of a polyolefin copolymer, particularly of a polypropylene copolymer. It should be borne in mind here that the lubricant can be or is contained in the sheath and the additive that reduces the migration speed of the lubricant is (additionally) contained. In the second embodiment, a polyolefin copolymer or a polypropylene copolymer is preferably selected for the sheath that has a melt flow index (MFI) of from 20 to 70 g/10 min, preferably from 25 to 50 g/10 min. An ethylene propylene copolymer with an ethylene content of from 1 to 6%, preferably from 2 to 6%, is advantageously used. It is recommended that the polyolefin copolymer or polypropylene copolymer chosen for the sheath be characterized by a narrow molar mass distribution and preferably by a molecular weight distribution or molar mass distribution ($M_w/M_n$) of from 2.5 to 6, preferably from 3 to 5.5, and very preferably from 3.5 to 5. In the context of the invention, the molecular weight distribution $M_w/M_n$ is according to gel permeation chromatography (GPC), particularly in accordance with ISO 16014-1:2003, ISO 16014-2:2003, ISO 16014-4:2003, and ASTM D 6474-12. It is recommended that a random polypropylene copolymer such as Borealis RJ377MO or Basell Moplen RP24R be used which has a nucleating agent or is otherwise modified for a high rate of crystallization. This latter-mentioned random polypropylene copolymer has a melt flow index of 30 g/10 min and a Vicat temperature of 120° C. (ISO 306/A50, 10 N), for example.

In the context of the second embodiment of the invention, at least one additive that reduces the migration speed of the lubricant is used in the sheath of the continuous filaments. This additive is at least one nucleating agent and/or at least one filler. According to an especially preferred embodiment of the invention, at least one nucleating agent is used. The nucleating agent is advantageously contained in the filaments in a proportion of from 500 to 2500 ppm with respect to the overall filament. The use of a nucleating agent from the group "aromatic carboxylic acid, salt of an aromatic carboxylic acid, sorbitol derivative, talc, kaolin, quinacridone, pimelic acid salt, suberic acid salt, dicyclohexyl naphthalene dicarboxamide, organophosphate, triphenyl compound, triphenyl dithiazine" has proven to be especially advantageous. A sorbitol such as dibenzyl sorbitol (DBS) or 1,3:2,4-bis (p-methylbenzylidene) sorbitol (MOBS) or 1,3:2,4-bis (3,4 dimethylbenzylidene) sorbitol (DMDBS) can be used as a nucleating agent. One preferred nucleating agent is a salt of an aromatic carboxylic acid, particularly an alkali metal salt of benzoic acid and, for example, sodium benzoate.

The nucleation of the sheath, particularly of the polyolefin copolymer or of the polypropylene copolymer of the sheath, with at least one nucleating agent reduces the migration speed of the lubricant in the sheath and thus enables the problem-free use of lubricants in the sheath with a view to solving the technical problem. At least one filler in the sheath can also reduce the migration speed of the lubricant. In this case, the filler used is preferably at least one metal salt and especially preferably at least one substance from the group "titanium dioxide, calcium carbonate, talcum."

In the context of the second embodiment of the invention, random polypropylene copolymers having a narrow molar mass distribution can be advantageously used as polypropylene copolymers for the sheath. In particular, polypropylene copolymers that are known from the injection-molding sector and often contain antistatic agents and nucleating agents can also be used here. Such antistatic agents (for example, fatty acid esters such as glycerol monostearate or ethoxylated fatty amines or alkylamines) can often already be sufficient as lubricants and would fall under the amount of lubricant claimed according to the invention. Optionally, additional lubricant can be added to the core and/or sheath if the already existing proportion of the copolymer is insufficient. The copolymer of the sheath can be blended with homopolypropylene. It lies within the scope of the invention for the viscosity of these mixtures to be lower than the viscosity of a homopolypropylene. The following remarks again relate both to the first embodiment and to the second embodiment of the invention: When a homopolypropylene is used in the first or second embodiment of the invention, it is preferably a homopolypropylene having the following properties. The melt flow index (MFI) is advantageously from 17 to 37 g/10 min, preferably from 19 to 35 g/10 min. It is recommended that the homopolypropylene have a narrow molar mass distribution in the range from 3.6 to 5.2, particularly in the range from 3.8 to 5. The measurement of the molar mass distribution has already been specified above. According to a preferred embodiment of the invention, at least one of the following products is used as a homopolypropylene: Borealis HF420FB (MF19), HG455FB (MF25), HG475FB (MF25), Basell Moplen HP561R (MFI25), and Exxon 3155 PP (MF135).

According to a very especially recommended embodiment of the invention, homopolypropylene and/or polypropylene copolymer, particularly ethylene propylene copolymer and/or mixtures thereof, is used both in the first and in the second embodiment both for the core and the sheath. The PP materials have proven to be very especially useful in the context of the invention.

It lies within the scope of the invention for a spunbonded nonwoven according to the invention to be produced by a spunbond process both in the first embodiment and in the second embodiment. Multicomponent filaments or bicomponent filaments having a core/sheath configuration are first wound as continuous filaments by at least one spinneret, and then these continuous filaments are cooled in at least one cooling device, upon which the continuous filaments pass through a stretcher in order to elongate the filaments. The drawn filaments are deposited in a deposit area, particularly on a screen deposit belt, as spunbonded nonwoven.

One especially recommended embodiment of the invention is characterized in that the assembly composed of the cooling device and the stretcher is a closed unit, with no additional air being supplied to the unit other than the cooling air that is supplied in the cooling device. In the context of the invention, this closed design has proven to be especially useful in the production of a spunbonded nonwoven according to the invention.

At least one diffuser is advantageously arranged between the stretcher and the deposit area or screen deposit belt. The continuous filaments emerging from the stretcher are passed through this diffuser and then deposited in the deposit area or onto the screen deposit belt. One recommended variant of the invention is characterized in that at least two diffusers, preferably two diffusers, are arranged one behind the other in the direction of filament flow between the stretcher and the deposit area. It is advantageous for at least one secondary air inlet gap for allowing ambient air to be present between the two diffusers. The embodiment with the at least one diffuser or with the at least two diffusers and the secondary air inlet gap has also proven to be especially suitable in terms of the production of the spunbonded nonwovens according to the invention.

After the deposition of the filaments into the spunbonded nonwoven, this spunbonded nonwoven undergoes compaction, precompaction according to a preferred embodiment, and then final compaction. The precompaction and/or compaction of the spunbonded nonwoven is advantageously performed with at least one calender. In that case, two interacting calender rolls are preferably used. According to one recommended embodiment, at least one of these calender rolls is heated. The embossing surface of the calender is advantageously 8 to 20%, for example 12%. In the context of the invention, when the degree of softness is determined in a spunbonded nonwoven according to the invention, on the one hand, and in a nonwoven of reference, on the other hand, the same precompaction and/or compaction of the spunbonded nonwoven is performed on both nonwovens.

The invention is based on the discovery that the spunbonded nonwovens according to the invention have an optimally smooth, soft feel and high level of strength nonetheless. This results in soft spunbonded nonwovens with good tensile strength. This is especially true for the preferred use of the polypropylene or polypropylene copolymers for the core and/or sheath of the continuous filaments of the spunbonded nonwoven according to the invention. It is also essential that, compared to known solutions, the evaporation of lubricant from the filaments can be effectively reduced, thereby preventing undesirable deposits in the system. The cleanliness of the system in comparison to the known measures can thus be increased, thereby enabling the efficiency and availability of the system to be increased as well. In particular, the lifespan of the system can be increased. The invention is also based on the discovery that inhomogeneous introduction of the lubricant into the filaments effectively contributes to the solution of the technical problem according to the invention. As will be demonstrated by the following embodiments, a level of strength can be achieved in the nonwovens in the production of the spunbonded nonwovens according to the invention that is comparable to that achieved with the measures that are known from practice, and particularly with lower energy input for the consolidation of the spunbonded nonwovens, particularly with low calender temperatures. Due to the high strength of the spunbonded nonwovens that is achieved according to the invention, material can also be saved in the production of the continuous filaments, particularly in comparison to other combinations of raw materials, such as PP/PE. Furthermore, the components can be easily recycled in the process for manufacturing the spunbonded nonwovens according to the invention. Due to the compatibility of the raw materials used, problem-free refeeding of recyclate is possible in high proportions. This also results in a significant cost advantage over a PP/PE combination, for example. The result is soft, smooth, and high-tensile spunbonded nonwovens that can be realized at relatively low cost.

BRIEF DESCRIPTION OF THE DRAWING

The invention is explained in greater detail with reference to an embodiment shown in the sole FIGURE of the drawing.

SPECIFIC DESCRIPTION OF THE INVENTION

Below, spunbonded nonwovens of bicomponent filaments having a core/sheath configuration were prepared according to the spunbond process described above. The materials used for the two components (core and sheath) were homopolypropylenes and polypropylene copolymers. In all of the embodiments, the spunbonded nonwoven deposited on the screen deposit belt was compacted using a calender having a U5714A engraving (12% embossing surface, round engraving points, 25 Fig/cm$^2$). The fineness of the filaments of all examples was about 1.6 to 1.8 denier. All samples were produced using a spinning system with the same or similar throughputs.

Comparative Example

Monocomponent filaments of homopolypropylene (Borealis HG455FB with MF125) were produced. The calendering was carried out with a surface temperature of the calender rolls of about 148° C. The spunbonded nonwoven produced has good strength, but, but no satisfactorily soft feel compared to the subsequent embodiments.

Embodiment 1

A spunbonded nonwoven of bicomponent filaments was produced according to the first embodiment of the invention, with both the core and the sheath being made of homopolypropylene (Borealis HG455FB with MF125) with 8% of an "L-MODU X901 S" polypropylene from the company Ldemitsu as a soft polypropylene additive. The mass ratio between the core and the sheath was 70:30. Only the erucic acid amide-based SL05068PP lubricant from Constab was contained. The content of the lubricant was 2000 ppm with respect to the overall filament. The spunbonded nonwoven was calendered with a surface temperature of the calender rolls of about 142° C. The spunbonded nonwoven produced from these continuous filaments had a smooth, soft feel after one day of storage.

Embodiment 2

The spunbonded nonwoven of this embodiment was also produced according to the first embodiment of the invention. The bicomponent filaments of this spunbonded nonwoven contained homopolypropylene (Basell Moplen HP561R with MF125) in both the core and the sheath with 10 wt % of a soft copolypropylene additive (Exxon Vistamaxx VM 6202). Here as well, the mass ratio between the core and the sheath was 70:30. Again, the lubricant used was the erucic acid amide-based SL05068PP lubricant from Constab. This lubricant was contained only in the core, and the content of the lubricant was 2500 ppm with respect to the overall filament. The calendering of the spunbonded nonwoven was performed with a surface temperature of the calender rolls of 132° C. The feel of the filament produced had to be classified as blunt at first, but soft feel appeared after one day of storage. This illustrates the delayed migration of the lubricant.

Embodiment 3

This spunbonded nonwoven was produced according to the second embodiment of the invention. The bicomponent filaments contained homopolypropylene (Borealis HG475FB) in the core and polypropylene copolymer (Basell Moplen RP248R with MEI 30) in the sheath. The mass ratio between the core and the sheath was 70:30. The polypropylene copolymer of the sheath contains a nucleating agent and an antistatic agent. The calendering of the spunbonded nonwoven was carried out at a surface temperature of the calender rolls of 121° C. The feel of the spunbonded nonwoven produced had to be classified as blunt at first, but the spunbonded nonwoven acquired a soft feel after one day of storage. This illustrates again a delayed migration of the lubricant or antistatic agent here.

Embodiment 4

The spunbonded nonwoven was produced according to the second embodiment of the invention. The core of the bicomponent filaments consisted of homopolypropylene (Borealis HG475FW with MF125) and the sheath consisted of polypropylene copolymer (Basell Moplen RP248R with MF130).

The mass ratio between the core and the sheath was 50:50. The polypropylene copolymer contained a nucleating agent and an antistatic agent. The compaction was carried out with calender rolls having a surface temperature of 121° C. The feel of the spunbonded nonwoven produced was blunt at first, and a smooth, soft feel developed after one day of storage. This again illustrates the delayed migration of the stearate that was used as lubricant. Compared to embodiment 3, a reduced strength of the nonwoven fabric was observed (see table below) that can be attributed to the greater proportion of polypropylene copolymer compared to homopolypropylene.

Embodiment 5

The bicomponent filaments of this spunbonded nonwoven had homopolypropylene (Borealis HG475FB with MF125) in the core and polypropylene copolymer in the sheath. The mass ratio of the core to the sheath was 70:30. The polypropylene copolymer used is comparable to the Moplen RP248R copolymer but has no nucleating agent and no antistatic agent. Compaction was performed with calender rolls having a surface temperature of 121° C. Even after three days of storage time, the spunbonded nonwoven produced in this way did not achieve the smooth, soft feel of embodiment 3. This shows that the use of polypropylene copolymer alone is not sufficient and that a migrating lubricant is required in order to achieve the properties according to the invention.

In the table below, the weights per unit area of the spunbonded nonwovens are given in g/m$^2$, and the strengths in the machine direction (MD) and transverse to the machine direction (CD) are given in N/5 cm for the above examples. The strengths were measured according to EDANA ERT 20.2-89 with a 100 mm clamping length and 200 mm/min draft speed. Comparative example V is compared here with embodiments 1 to 5:

| Example | Weight/area | Strength MD | Strength CD |
|---|---|---|---|
| "V" | 22 | 49 | 35 |
| 1 | 22 | 44 | 28 |
| 2 | 22 | 39 | 31 |
| 3 | 20 | 55 | 31 |
| 4 | 20 | 48 | 30 |
| 5 | 20 | 55 | 35 |

It should be emphasized that the spunbonded nonwovens of embodiments 3 to 5 were compacted at a substantially lower calender temperature than in comparative example V. Nevertheless, comparable strengths are observed, so that the energy input was able to be reduced in the production of the spunbonded nonwovens according to embodiments 3 to 5. The lower calender temperature promotes the soft feel and thus makes it possible to reduce the additional lubricant to be added.

Embodiment 6

This embodiment concerns the difference in the degree of hardness or in relation to the hardness measurements listed. Measurements of the degree of hardness were carried out on a spunbonded nonwoven S1 according to the invention and on a nonwoven of reference V1 using a commercially available TSA (Tissue Softness Analyzer) measuring device from Emtec, Leipzig, Germany. The method of measurement has already been explained above. The measuring head was pressed against the nonwoven surface with a force of 100 $M_n$. It was measured here on the spunbonded nonwoven surface facing away from the screen deposit belt. The measuring head was equipped with eight rotating or rotatable measuring blades, and the speed during the measurement was 2/sec. A sound intensity/frequency spectrum was recorded for the spunbonded nonwoven according to the invention and the nonwoven of reference, respectively, and the sound intensity of the peak maximum (TS7 value) was determined at 6550 Hz in each case. In each case, 5 individual measurements were averaged. The two spunbonded nonwovens were made using the same spunbond apparatus, precompacted in the same manner (i.e., under the same calender compaction conditions), and both spunbonded nonwovens had filaments of the same titer of 1.8 denier. The difference between the filaments of the two spunbonded nonwovens was the distribution of the lubricant in the polymer melt as it exited the spinning plate before the respective filament was spun. In the spunbonded nonwoven S1 according to the invention, the filaments consisted of a homogeneous mixture of homopolypropylene and polypropylene copolymer. The raw materials for the bicomponent filaments were selected analogously to embodiment 2 above, the lubricant content with respect to the overall filament was 2000 ppm, and a "U2888" calender engraving with a 19% surface ratio was used. The content of the core was 50% (mass ratio between core and sheath 50:50). Accordingly, 4000 ppm of lubricant were added to the core of the bicomponent filaments. A spunbonded nonwoven of filaments made of the same components was used as nonwoven V1 of reference, but the lubricant was homogeneously distributed over the filament cross section at 2000 ppm. For both nonwovens S1 and V1, the sound intensity values (TS7 values) were determined for three times, namely 15 minutes, 2 hours, and 96 hours after the filaments were deposited on a screen deposit belt. Sound intensity values for the spunbonded nonwoven S1 according to the invention and for the nonwoven V1 of reference are shown in the following table:

| | L (dBV$^2$ rms) | | in % | |
|---|---|---|---|---|
| | S1 | V1 | S1 | V1 |
| 15 min | 4.31 | 3.98 | 108.2 | 100 |
| 2 hours | 4.42 | 4.16 | 106.3 | 100 |
| 96 Hours | 3.93 | 3.84 | 102.2 | 100 |

The sole FIGURE shows the sound intensity values TS7 (in dBV2 rms) of the peak maximum at 6550 Hz as a function of the time of measurement. The TS7 value that was determined 15 minutes after depositing of the filament is shown at the far left, and the TS7 value that was determined 2 hours after depositing of the filament is shown to the right of that. The TS7 value that was determined 4 days or 96 hours after the depositing of the filament is shown at the far right. The solid line characterizes the TS7 values for the spunbonded nonwoven S1 according to the invention, and the dashed line shows the TS7 values for the nonwoven V1 of reference. It can be seen here that the spunbonded nonwoven S1 according to the invention initially (after 15 minutes and after 2 hours) has a substantially higher sound intensity and thus a lower degree of softness or higher degree of hardness than the nonwoven V1 of reference. This is because the lubricant migrates much more slowly to the filament surface in the filaments of the spunbonded nonwoven S1 according to the invention. By contrast, a relatively fast migration takes place in the nonwoven of reference, so that high degrees of softness and low degrees of hardness are already achieved relatively early. The rise in the curve between 15 minutes and 2 hours for both spunbonded nonwovens is explained by the initial recrystallization of the polypropylene blend that stiffens the filaments. This shape of the curves can be considered to be typical of this combination of raw materials. As expected, both migration of the lubricant and recrystallization simultaneously affect softness. Since migration speeds can also change depending on the respective crystallinity, there is no universally applicable curve progression; this is raw material-specific. After 96 hours, the sound intensity values and thus the degrees of softness or degrees of hardness of the spunbonded nonwoven S1 according to the invention on the one hand and of the nonwoven V1 of reference on the other hand coincide or virtually coincide. The delayed migration of the lubricant to the filament surface in the spunbonded nonwovens according to the invention has the advantage that, during manufacture of the filaments, substantially less outgassing of lubricant from the filaments takes place, so the system components are correspondingly less contaminated. At the same time, this has a positive influence on winding characteristics. Apart from that, it can be seen from the percentage data in the table that the sound intensity value of the spunbonded nonwoven according to the invention is more than 3% higher than the sound intensity value of the nonwoven V1 of reference within the first 150 minutes after the depositing of the filament and, accordingly, the degree of hardness of the spunbonded nonwoven S1 according to the invention is more than 3% higher than the degree of hardness of the nonwoven V1 of reference. It can also be seen that the finished spunbonded nonwovens have become softer, independent of any subsequent recrystallization that demonstrates the effect and purpose of the lubricant.

Embodiment 7

With the same system and compaction as in embodiment 6, the combination of raw materials was chosen in keeping with embodiment 5, but with a lubricant. A Moplen HP561R homopolypropylene was used in the core, and the random CoPP with MFR 30 from embodiment 5 was used in the sheath. A core/sheath ratio of 70:30 was set, and the same calender temperature was used as in embodiment 6. In the spunbonded nonwoven S2 according to the invention, 2900 ppm of lubricant were added only in the core. In nonwoven V2 of reference, 2000 ppm of lubricant were added both to the core and to the sheath. A similar relationship is again observed here in the TS7 values to that observed in embodiment 6; however, the sheath raw material used here results in a different temporal course due to its different base softness and crystallization and migration speed. The TS7 difference becomes particularly apparent here after 2 hours.

| | L ($dBV^2$ rms) | |
|---|---|---|
| | S2 | V2 |
| 15 min | 5.03 | 4.91 |
| 2 hours | 5.64 | 4.86 |
| 96 Hours | 4.33 | 4.19 |

Here, too, the deposited spunbonded nonwoven is softer (has a lower TS7 value) than the newly produced spunbonded nonwoven.

The following table shows the TS7 relationship of spunbonded nonwovens S according to the invention to nonwovens V of reference (embodiments 6 and 7) after 15 minutes, 2 hours, and 96 hours, as well as the strength values after production and the weights per unit area of the spunbonded nonwovens. Strengths and weights per unit area were determined according to the methods described above using a draft speed of 200 mm/min for the strength measurement.

| Sample | V1 | S1 | V2 | S2 |
|---|---|---|---|---|
| TS7 (15 min) [%] | 100 | 108.2 | 100 | 102.4 |
| TS7 (2 hrs) [%} | 100 | 106.3 | 100 | 116.1 |
| TS7 (96 hrs) [%} | 100 | 102.2 | 100 | 102.5 |
| Strength MD [ND/5 cm] | 41.6 | 39.4 | 44.2 | 42.3 |
| Strength CD [N/5 cm) | 23.7 | 23 | 28.1 | 28.4 |
| Weight/Area $g/m^2$ | 20.6 | 20.3 | 20.6 | 20.3 |

A strength advantage is observed in the embodiment 7 compared to embodiment 6. This demonstrates the advantage as well as the possibilities of bicomponent technology.

The invention claimed is:

1. A nonwoven spunbonded of filaments, wherein the filaments are of continuous, thermoplastic multicomponent and spunbond construction having a core/sheath configuration, the filaments contain at least one lubricant, the lubricant is present in the core exclusively or in a quantity of at least 98 wt % of lubricant in the filament, a mass ratio between the core and the sheath being is from 50:50 to 75:25, the core consists essentially of homopolypropylene, the sheath consists essentially of a polypropylene copolymer with a molar mass distribution of 3.5 to 5, or a mixture of homopolypropylene and a polypropylene copolymer with a molar mass distribution of 3.5 to 5, and the proportion of the lubricant with respect to the overall filament corresponds to 250 to 5500 ppm.

2. The spunbonded nonwoven defined in claim 1, wherein the mass ratio between the core and sheath is 67:33 to 73:27.

3. The spunbonded nonwoven according to claim 1, wherein the lubricant comprises fatty acid ester, fatty acid alcohol, or fatty acid amide.

4. The spunbonded nonwoven according to claim 1, wherein the lubricant is at least one stearate or at least one erucic acid amide or at least one oleamide.

* * * * *